US007882676B2

(12) United States Patent
Ellis

(10) Patent No.: US 7,882,676 B2
(45) **Date of Patent: *Feb. 8, 2011**

(54) CONSTRUCTION BLOCKING BRACKET

(76) Inventor: Jeffrey Thomas Ellis, 3395 Crestview Dr., Bethel Park, PA (US) 15102

( * ) Notice: Subject to any disclaimer, the term of this patent is extended or adjusted under 35 U.S.C. 154(b) by 0 days.

This patent is subject to a terminal disclaimer.

(21) Appl. No.: 12/587,896

(22) Filed: Oct. 14, 2009

(65) Prior Publication Data

US 2010/0146903 A1 Jun. 17, 2010

Related U.S. Application Data

(63) Continuation of application No. 12/082,410, filed on Apr. 10, 2008, now Pat. No. 7,621,096.

(60) Provisional application No. 60/922,846, filed on Apr. 11, 2007.

(51) Int. Cl.
*E04B 1/38* (2006.01)

(52) U.S. Cl. ..... 52/712; 52/489.1; 52/489.2

(58) Field of Classification Search ..... 248/300; 52/480, 762, 763, 474, 479, 715, 846, 241, 52/220.7, 481.1, 481.2, 489.2, 712, 317, 52/716.1, 716.06, 285.3, 489.1
See application file for complete search history.

(56) References Cited

U.S. PATENT DOCUMENTS

| | | | |
|---|---|---|---|
| 3,001,615 | A | 9/1961 | Ries |
| 3,694,986 | A | 10/1972 | Yamamoto et al. |
| 4,294,052 | A | 10/1981 | Blauer |
| 6,609,344 | B2 | 8/2003 | Saldana |
| 6,799,407 | B2 | 10/2004 | Saldana |
| 6,928,785 | B2 | 8/2005 | Shipman et al. |
| 7,216,465 | B2 | 5/2007 | Saldana |
| 2006/0101761 | A1 | 5/2006 | Miller |

*Primary Examiner*—David Dunn
*Assistant Examiner*—Adam Barlow
(74) *Attorney, Agent, or Firm*—Barbara E. Johnson, Esq.

(57) ABSTRACT

A bracket for use with metal construction framing which is a generally planar construct having a first outer flange and a second outer flange, configured to form a recess between such flanges suitable to engage at least one face of a metal construction stud and to interlock with the stud via at least two non-longitudinal tabs.

5 Claims, 3 Drawing Sheets

CONSTRUCTION BLOCKING BRACKET

CROSS REFERENCE TO RELATED APPLICATIONS

This patent application is a continuation of U.S. application Ser. No. 12/082,410, filed Apr. 10, 2008 now U.S. Pat. No. 7,621,096, which claims priority to U.S. patent application No. 60/922,846 filed Apr. 11, 2007, and which applications are incorporated herein by reference.

BACKGROUND OF THE INVENTION

1. Field of the Invention

The invention pertains to a bracket for use with metal constructions studs (metal framing), for use as a construction blocking bracket to align and secure construction panels, boards, molding, baseboards and other wall construction items adjacent one or more metal construction studs. The inventive bracket is designed to provide maximum convenience and stability to the studs and walls without adding strain or any substantial weight of its own to stress the associated stud(s) or wall.

2. Orientation to the Prior Art

In contrast to traditional wood studs used in interior residential wall construction in past decades, modern emphasis on fire-resistance and fire-proof construction has led to burgeoning popularity of metal framing in wall, floor and ceiling construction—even in residential applications and certainly in commercial constructions large and small. Indeed, at this writing both interior and exterior construction emphasize metal framing more than ever before, and the popularity of metal framing is likely to continue to grow not only for fire prevention but for the economic and labor-saving features metal framing can provide, particularly in a pre-fabrication setting intended to maximize ease of actual construction.

Whereas traditional wood construction studs were ordinarily solid wood, most if not all metal construction studs or framing resemble a C channel or similar configuration, so that sheet metal—generally galvanized steel sheet—is fabricated into a long construct having a C or U shape in cross section (and a folded sheet edge). This is so even though the term "U Channel" itself typically refers in the industry to a framing reinforcement construct which runs through "stud knockouts," or prefabricated apertures in metal studs or framing, to reinforce the metal studs primarily against longitudinal rotation. Metal framing is extremely versatile and can be cut and fastened in a variety of ways, and can accept direct screw or nail attachments with the appropriate parts and equipment. However, current construction goals emphasize the need for innovation in the area of pre-fabrication, in the sense that construction devices ought best to be versatile to allow easy assembly if not fastener-free interlocking of common construction materials in a wide variety of configurations. Heretofore, constructs for versatile connection with metal framing have been rare or unknown. Accordingly, a need remains for an easy-to-hold-and-use construct which can prevent metal studs from rotating, facilitate the securing of a wide variety of construction materials to the metal framing in virtually any orientation, and interlock with a metal stud in such a way that in at least some applications no additional fasteners are required.

SUMMARY OF THE INVENTION

In order to meet this need, the present invention is a bracket which, like the metal stud with which it is generally intended to be used, is typically fabricated from a single sheet of metal, usually galvanized sheet steel. Although the shape and proportions of the bracket are shown in the accompanying figures, the bracket contains two predominant structural features, namely, a three-sided rectangular recess and two non-longitudinal tabs. The bracket thus has a generally planar shape with a three-sided recess in the middle, with the recess's being defined by a first long wall, a second shorter wall and a third non-planar wall. The non-planar wall bears two non-longitudinally oriented tabs at each end, which angle into the three-sided recess. The three-sided recess engages with a metal (or any) construction stud and the two non-longitudinal tabs secure the metal stud (usually but not necessarily always at a side face of the stud) within the recess. Overall, the bracket facilitates further assembly of the already installed stud and its adjacent structures including but not limited to tracks, base boards, wall panels, wall board and dry wall, and decorative trim including chair rails, moldings and ceiling panels.

DESCRIPTION OF THE PREFERRED EMBODIMENTS

The present invention is a bracket for use with metal construction framing. In an embodiment of the invention, the bracket is a 22 gauge folded, notched, prepunched galvanized sheet metal bracket with non-longitudinal tabs thereon. The bracket is designed for use to retain and support pre-cut (or any) wood or other blocking between metal studs for wood baseboard or other applications where construction material backing or blocking is required within metal stud wall construction. Although the shape and proportions of the bracket are shown in the accompanying FIGS. 1-4 (which show one embodiment of the invention), the bracket contains two main structural features, namely, a three-sided rectangular recess and two non-longitudinal tabs. The bracket thus has a generally planar shape with a three-sided recess generally in the center, with the recess's being defined by a first long wall, a second shorter wall and a third non-planar wall. The non-planar wall bears two non-longitudinally oriented tabs at each end, which angle into the three-sided recess. The three-sided recess engages with one face of a metal construction stud and the two non-longitudinal tabs secure the metal stud within the recess by interlocking behind the aforesaid stud face. Overall, the bracket facilitates further assembly of the already installed stud and its adjacent structures including but not limited to tracks, base boards, wall panels, wall board and dry wall, and decorative trim including chair rails, moldings and ceiling panels.

Additional features shown in the Figures and discussed more particularly below also contribute to the versatility of the present bracket. For example, with the non-longitudinal tabs' being located on only one side of the bracket, the bracket may be used with the non-longitudinal tabs' on either the left or right by rotating the bracket 180 degrees. In other words, the present bracket may be used with either left-facing or right-facing metal studs simply by flipping it (rotating it 180 degrees relative to the vertical). Also, with the recess' being defined by a second shorter wall (see below), the remaining portions of the bracket may optionally be used to extend down or up into associating track or other stud cooperating structures, even while the bracket is also suitable as is for simple stud interfaces at central wall locations such as for a chair rail and etc. Also, unlike prior art metal stud interfacing constructs which array metal plates on the adjacent construction materials and thus interfere with pin nailing trims or molding into the backing or block, the present invention's flanges expose the adjacent blocking from stud to stud, for a maximum expanse of blocking material available for further pin nailing or fastening. These additional features are discussed further below the following more particular descriptions of the drawings.

Figure 1:
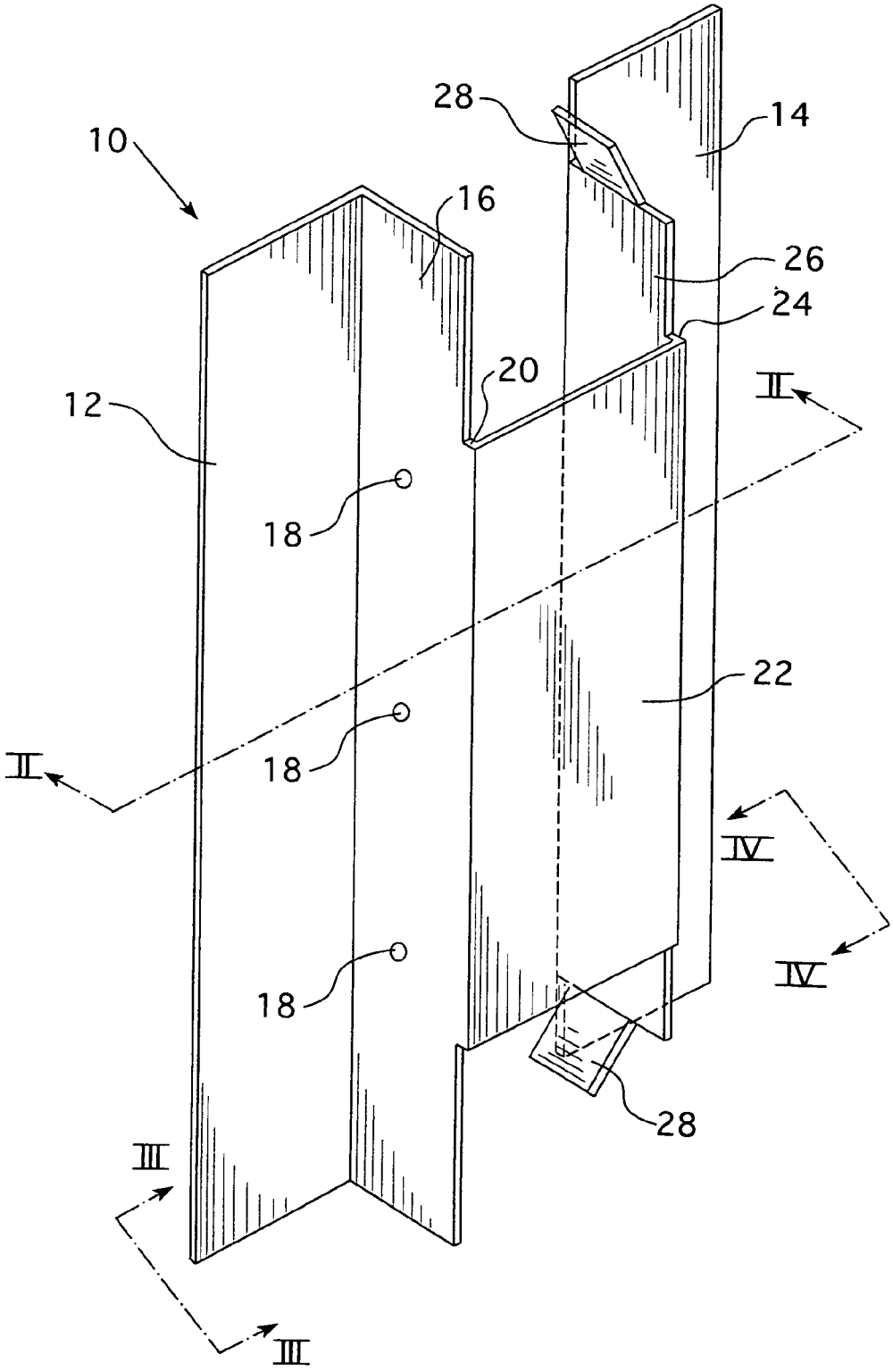
FIG. 1 is a perspective view of the bracket of the present invention.

Referring now to FIG. 1, an embodiment of the instant bracket is shown in perspective view. The bracket 10 comprises a first outer planar flange 12 and a second outer planar flange 14 which together generally define a plane from which recedes a stud-engaging recess in the bracket. This recess, in the embodiment under discussion, has at its periphery the first long wall 16 (having optional first long wall apertures 18 therein), a second shorter wall 22 (i.e., the second "shorter" wall 22 is shorter, in the lengthwise direction of an associated metal stud, relative to the first long wall 16), and a third non-planar wall 26. The third non-planar wall 26 bears at least two non-longitudinal tabs 28 which generally extend no higher or lower than the corresponding length of the first long wall 16, and generally do not extend to quite the same length of the first long wall 16 due to the typically bent or angled configuration of the non-longitudinal tabs 28. However, it should be noted that as long as the non-longitudinal tabs 28 are not co-planar with their connection structure (hence the term "third non-planar wall" 26), the non-longitudinal tabs 28 may extend into the above-described recess at a wide variety of angles or may even be separately manufactured tabs, knobs or extensions forming part of the third non-planar wall 26. As a practical matter, however, it is generally most expedient to form the present bracket from a single sheet of metal and, when fabricated from a single sheet, the non-longitudinal tabs 28 will general be folded or bent (relative to the vertical) into the above-mentioned recess at an angle of greater than 5 degrees, more preferably at an angle of greater than 30 degrees, and most preferably at an angle of about 45 degrees, plus or minus 5 degrees, for maximum overall stability of interlocking of both the bracket and the associated metal stud. Also, the non-longitudinal tabs 28 are offset, relative to the plane of the second shorter wall 22, by the traditional thickness of the engaging wall of a metal study, typically 3-8" or ¼" but in any case by an offset sufficient to allow the tabs 28 to engage and to clip behind the stud wall or face whose front engages the aforementioned recess.

Further referring to FIG. 1, in the illustrated embodiment of the invention the recess to receive a portion of a metal construction stud is not formed by three simple walls. The first long wall 16 bears a first long wall extension 20 as shown, which connects to the second shorter wall 22 as illustrated. Likewise, the second shorter wall 22 bears a second shorter wall extension 24 which connects to the third non-planar wall as illustrated. This configuration provides a number of advantages to a builder or artisan during installation. First, the immediately afore-described configuration allows the installer to place the bracket over a side of a metal stud while still being able to grip the sides of the stud face thus engaged, which greatly facilitates sliding the bracket up or down the stud to its desired location. Also, the configuration allows the non-longidinal tab 28 width to be relatively wider than it could be if its offset did not include the space of the protrusion formed by the cooperating first long wall extension 20 and second shorter wall extension 24. Finally, although this list is by no means exhaustive, the protruding nature of the second shorter wall 22 relative to all its adjacent structures provides a natural handle-like center to the bracket which the user grasps while the non-longitudinal tabs 28 are positioned behind the stud wall before and as the bracket is rotated into its final position with easy finger-access to the stud itself just above and below the second shorter wall 22.

With continued reference to FIG. 1, the relatively short length of second shorter wall 22 provides versatility in that either or both longer ends of the first long wall 16 and the third non-planar wall 26 can extend up or down into associated channels or structures, such as track, which may run above or below the metal stud itself. However, the presence of these longer ends of either the first long wall 16 or the third non-planar wall 26 do not detract from installations which occur in the middle of (rather than at either end of) a metal stud, thus providing a versatile bracket that can be used in association with a metal stud at any point along the length of the stud.

Figure 2:
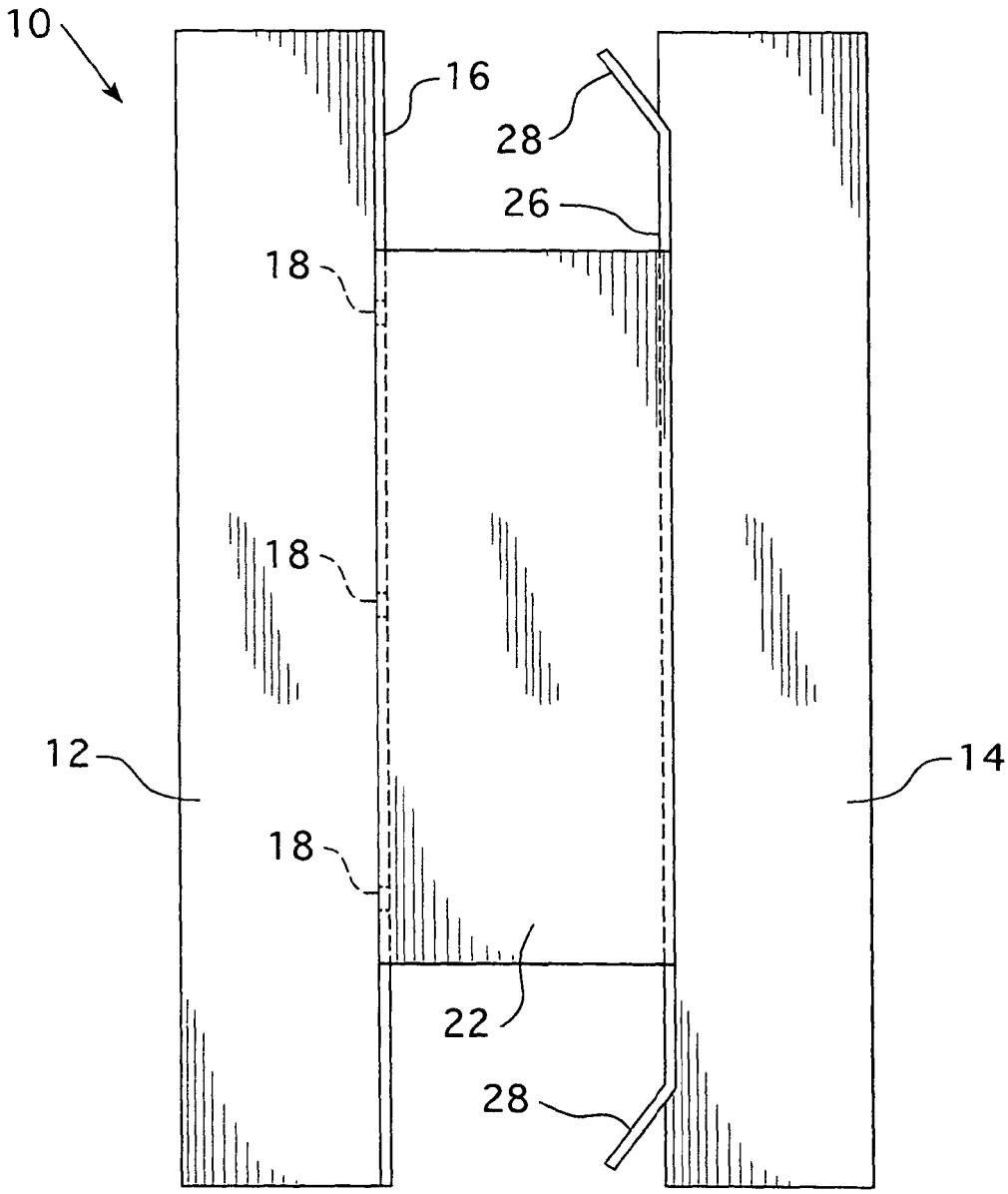
FIG. 2 is a view along line II-II of FIG. 1.

Referring now to FIG. 2, which is a view along line II-II of FIG. 1, the same features as described above are apparent. In the embodiment shown in the Figures and as illustrated in FIG. 2, it is readily visible that the non-longitudinal tabs 28 are angled at about 45 degrees from the vertical and into the recess generally defined by the first long wall 16, the second shorter wall 22 and the third non-planar wall 26.

Figure 3:
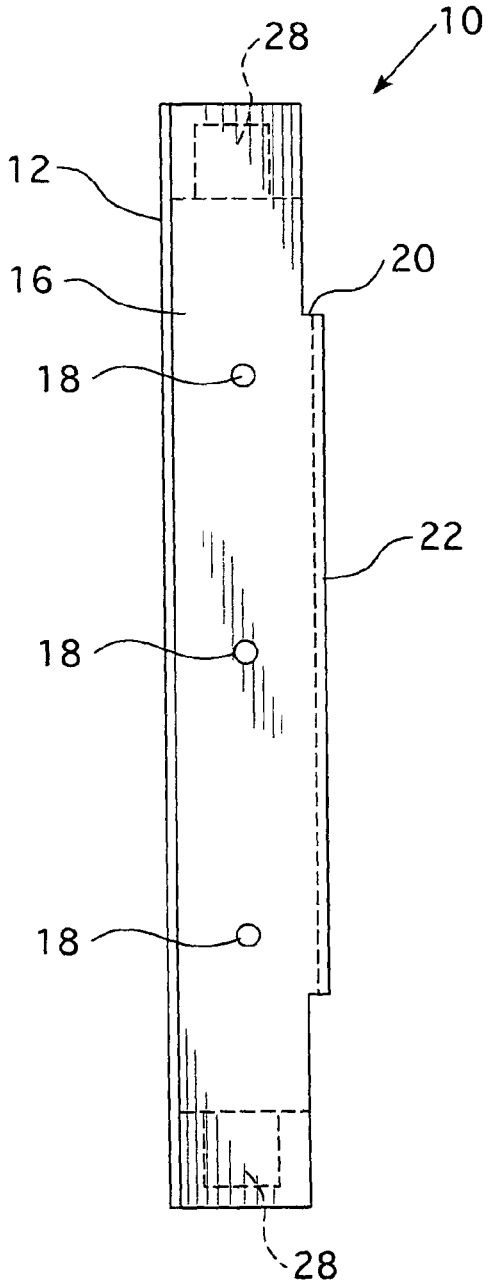
FIG. 3 is a view along line III-III of FIG. 1.
Figure 4:
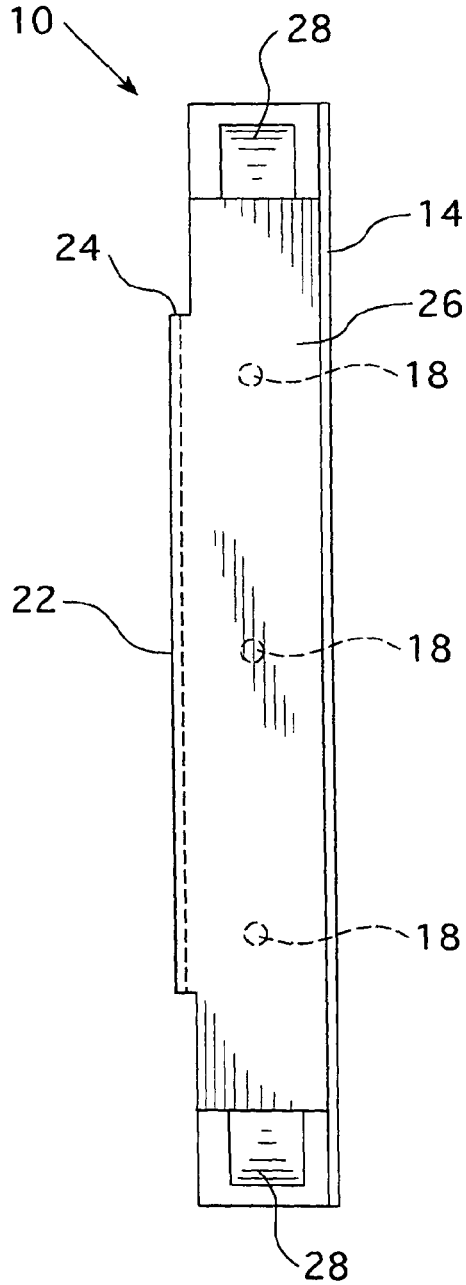
FIG. 4 is a view along line IV-IV of FIG. 1.

FIGS. 3 and 4 are views along lines III-III and IV-IV of FIG. 1.

In all the Figures, severe right angles and sharp corners along interior fold lines are somewhat exaggerated in their illustration compared to the angles in an actual bracket fabricated of a single sheet of folded metal. Folded metal structures are known in the art to have generally radial interior folds and creases, and this will be understood in construing the accompanying Figures.

Widespread variation on the embodiment of the invention illustrated in the Figures is possible without departing from the scope of the invention, including those variabilities already discussed above. For example, the lengthwise dimension of the bracket may range from about 6" to 24" or more, although bracket lengths of 6" and 12" are standard. By "lengthwise dimension" is meant the vertical dimension as shown in the Figures. Gauge of the sheet metal used to make the bracket can be 22 gauge or can range from 18-26 gauge, more preferably 20-24 gauge, and any metal can be used including but not necessarily limited to galvanized sheet steel. The positioning of apertures need not occur as shown in the Figures, because literally any face of the bracket can be pre-formed with any desired aperture for associated fasteners or other structures. The dimensions of the recess and associated bracket structures can be adjusted as long as the shape and spacing is such that the non-longitudinal tabs 28 engage and interlock the rear of the same stud or framing wall that presses against the cooperating face of the second shorter wall 22 of the bracket 10.

In terms most familiar to those in the construction business, the present bracket can be a 22 (or adjusted) gauge folded, notched, prepunched galvanized sheet metal bracket, having non-longitudinal tabs therein as illustrated, designed to retain and support pre-cut wood blocking between metal studs for wood baseboards or other applications where wood backing or blocking (or backing or blocking with other construction materials) is required. The bracket's sleek wrap-around design allows its tabs to latch behind the open side of the stud return, and the pre-punched holes on the opposite side of the bracket accommodate small panhead screws to fasten the bracket to the stud, thus eliminating any fasteners on the face of the bracket and the stud. Eliminating fasteners on the face of the stud allows the backside of the associated drywall to lay flat against the stud and the bracket thus prevents bulging or voids where the stud abuts the drywall. The bracket is also easy to install. The installer grasps the bracket, hooks the pre-bent tabs behind the open side of the stud and rotates the bracket against the adjacent face of the stud, while sliding the bracket up or down the stud and where applicable locking the stud into place. When this rotation and placement occurs at the base of a metal stud, no other connection or fastener is needed, especially if the bracket also interlocks into a base framing construct such as a track. For intermediate wall application, such as a chair rail, the bracket is latched, rotated and fastened into the stud with one to three panhead screws through the prepunched holes (the optional first long wall apertures 18 shown in FIG. 1).

A standardized 6" bracket will accommodate 4", 6" or 8" high ¾" fire-rated plywood or other material, infilling the predetermined stud space intervals. The 12" bracket will accommodate 10", 12" or 14" high ¾" fire-rated plywood or other material. Brackets of other lengths can thus easily be manufactured to accommodate other construction needs comparably.

The above-described versatility of the bracket design allows the height of the required wood blocking to be accommodated by stacking and spacing the brackets on studs as needed. The pre-cut wood blocking (i.e., ¾" fire-rated plywood or other) is positioned overlaying the bracket's outer flanges (i.e., the first and second outer planar flanges 12 and 14 as shown in the Figures) and can be secured if necessary by screws through the wood blocking and into the flange. When additional thickness in wood blocking is required, the versatility of the present bracket accommodates the extra thickness easily by allowing a second piece of blocking to be positioned behind the flange, thereby sandwiching the flange between the blocking using screws through the face blocking, flange and into the back blocking piece. The instant bracket thus provides easy installation of metal stud-associated wood blocking or backing (or blocking or backing any construction material) which in turn serves as or supports additional structures such as wood base, chair rail, picture molds, trims, marker boards, tack boards, wall bumpers, clash rails, toilet accessories, grasp rails, cabinets, counter tops, vanities, television and camera brackets, shelves and other surface wall mounted fixtures of virtually any type.

Although the invention has been described particularly above, in connection with specific disclosures and embodiments, alternatives and variations, the invention is only to be limited insofar as set forth in the accompanying claims.

The invention claimed is

1. A construction bracket for retaining and supporting blocking between metal studs, comprising a folded, notched, prepunched galvanized sheet metal bracket with non-longitudinal tabs fabricated from a single sheet of metal, wherein said folded, notched prepunched galvanized sheet metal bracket has a generally planar shape with a three-sided recess in the middle, with the three-sided recess's being defined by a first long wall, a second shorter wall and a third wall, with said third wall bearing two non-longitudinally oriented tabs at each end, which angle into the three sided recess, and which non-longitudinally oriented tabs are dimensioned with shape and spacing such that the tabs engage, latch and interlock the adjacent stud or framing wall.

2. The bracket as set forth in claim 1, wherein said at least two non-longitudinally oriented tabs extend into said recess at an angle relative to the vertical of at least 5 degrees.

3. The bracket as set forth in claim 1, wherein said at least two non-longitudinally oriented tabs extend into said recess at an angle relative to the vertical of at least 45 degrees.

4. The bracket as set forth in claim 1, wherein said first long wall contains apertures therein.

5. The bracket as set forth in claim 4, wherein said bracket is fabricated from a single sheet of metal having a gauge between 18-26.

* * * * *